US005453018A

United States Patent [19]

Ito et al.

[11] Patent Number: 5,453,018

[45] Date of Patent: Sep. 26, 1995

[54] LOW INSERTING AND EXTRACTING FORCE CONNECTOR

[75] Inventors: Keiichi Ito; Hirotaka Noda; Nobutoshi Hagiwara, all of Aichi; Naoto Taguchi, Shizuoka; Yuji Hatagishi, Shizuoka; Toshifumi Matsuura, Shizuoka, all of Japan

[73] Assignees: Yazaki Corporation, Tokyo; Toyota Jidosha Kabushiki Kaisha, Aichi, both of Japan

[21] Appl. No.: 104,895

[22] Filed: Aug. 12, 1993

[30] Foreign Application Priority Data

Aug. 19, 1992 [JP] Japan ..... 4-058172 U

[51] Int. Cl.[6] ..... H01R 13/62

[52] U.S. Cl. ..... 439/157; 439/153

[58] Field of Search ..... 439/152–160, 439/372

[56] References Cited

U.S. PATENT DOCUMENTS

| | | | |
|---|---|---|---|
| 5,135,410 | 8/1992 | Kawase et al. | 439/157 |
| 5,172,998 | 12/1992 | Hatagishi | 403/27 |
| 5,178,553 | 1/1993 | Hatagishi et al. | 439/157 |
| 5,201,665 | 4/1993 | McCardell, Jr. et al. | 439/157 |
| 5,230,635 | 7/1993 | Takenouchi et al. | 439/157 |

FOREIGN PATENT DOCUMENTS

| | | |
|---|---|---|
| 0459448 | 5/1991 | European Pat. Off. . |
| 0034672 | 1/1991 | Japan . |
| 4218279 | 8/1992 | Japan . |
| 2260865 | 4/1993 | United Kingdom . |

*Primary Examiner*—David L. Pirlot

*Attorney, Agent, or Firm*—Sughrue, Mion, Zinn, Macpeak & Seas

[57] ABSTRACT

Disclosed is an engagement drive cam to establish an initial engagement position of a pair of connector housings at the time of engaging the pair of connector housings having the engagement drive cam. The engagement drive cam having cam grooves is arranged on a female connector housing so as to be turnable around a support shaft. Driven pins entering into the cam grooves are arranged on a male connector housing A. Colliding stepped portions for colliding against the drive pins are arranged at entrance portions of the cam grooves, so that the colliding stepped portions are on a line of engagement direction passing through the support shaft.

7 Claims, 5 Drawing Sheets

LOW INSERTING AND EXTRACTING FORCE CONNECTOR

BACKGROUND OF THE INVENTION

1. Field of the Invention

The device relates to a lever-type connector rerquiring a low inserting and extracting force applied for connection between wire harness or between a wire harness and electric appliance.

2. Related Art

In FIG. 8 (Unexamined Japanese Utility Model Publication Hei. 3-4672), an engagement drive cam c is pivotally arranged on a male connector housing a by a support shaft b. Driven pins e project from a female connector housing d.

At the initial stage of engaging the male and female connector housings a, d, the driven pins e are positioned at entrance portions of cam grooves $c_1$ of the engagement drive cam c (FIG. 8 (A)). By rotating the engagement drive cam c from this condition, the female connector housing d is drawn near by engagement of the cam grooves $c_1$ with the driven pins 3, which in turn causes the female and male connector housings a, d to be engaged with each other with a low inserting force by lever action of the engagement drive cam c (FIG. 8 (C)).

By the way, at the above-described initial engagement stage of the male connector housing a with the female connector housing d, collision of the driven pins e against side portions $c_2$ of the cam grooves $c_1$ in the engagement drive cam c produces a rotary force against the engagement drive cam c as indicated by an arrow p. This causes the engagement drive cam c to automatically turn, so that the male and female connector housings a, d become engaged with each other from the initial engagement condition (half-engaged condition). As a result, terminal fittings (not shown) contained in the male and female connector housings a, d are brought into contact with each other for accidental conduction of a circuit at the initial half-engaged stage.

In another case where a plurality of connector housings on one side are engaged with a plurality of interlocking engagement drive cams arranged on a connector housing on the other side, a series of engagement drive cams turn as shown in FIG. 8 (B) at the initial stage of engaging a first connector housing on the one side with the connector housing on the other side, thereby making it impossible to bring subsequent connector housings on the other side into initial engagement due to the turning of the cam grooves.

SUMMARY OF THE INVENTION

The device has been made in view of the above circumstances. Accordingly, the object of the device is to establish the initial engagement position of a pair of connector housings by an engagement drive cam while stopping the engagement drive cam form turning by collision of the engagement drive cam against driven pins at the time of engaging the pair of connector housings.

To achieve the above object, a low inserting and extracting force connector comprises a pair of connector housings engageable each other; an engagement drive cam having cam grooves, the engagement drive cam being arranged so as to be turnable around a support shaft on one of a pair of connector housings engageable with each other; driven pins, arranged on the other connector housing, for entering into the cam grooves; and initial engagement means for provisionally engaging said pair of connector housings by coming into collision with the drive pins, the initial engagement means being positioned at a rear side defined by a moving direction of the driven pins.

According to another object of the preset invention, a low inserting and extracting force connector comprises: a plurality of female and male connector housings engageable each other; an engagement drive cam having cam grooves, the engagement drive cam being arranged so as to be turnable around a support shaft on the female connector housings engageable with each other; driven pins, arranged on the male connector housings, for entering into the cam grooves; and initial engagement means for provisionally engaging the male and female connector housings by coming into collision with the drive pins, the initial engagement means being positioned at a rear side defined by a moving direction of the driven pins.

The engagement drive cam does not turn when the driven pins collide against the colliding stepped portions at the initial stage of engaging the pair of connector housings.

DETAILED DESCRIPTION OF THE PREFERRED EMBODIMENTS

Preferred embodiments of the present invention will now be described with references with to the accompanying drawings.

Figure 1:
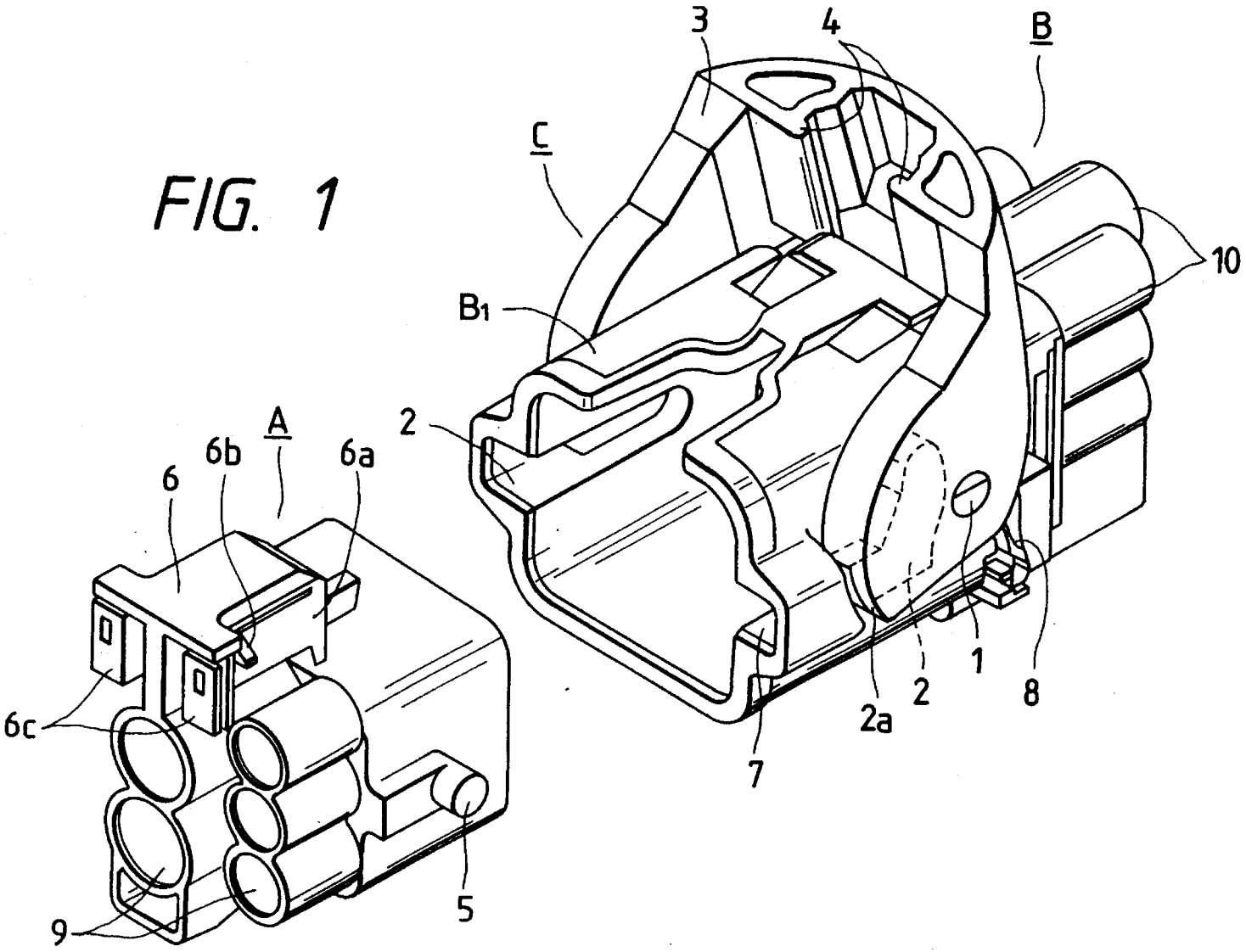
FIG. 1 is a perspective view of first embodiment of the device with female and male connector housings shown in a separated condition.

FIG. 1 is a perspective view of an embodiment of the device with female and male connector housings being separated from each other. Reference character A designates a male connector housing made of a synthetic resin; B, a female connector housing made of the same; and C, engagement drive cam arranged so as to be rotatable around a support shaft 1. The engagement drive cam C has cam grooves 2 and lock holding portions 4 on an operation lever portion 3 thereof.

Driven pins 5 project from both sidewalls of the male connector housing A. A lock portion 6 is arranged on the male connector housing A. In the lock portion 6 lock projections **6*b* for being held by the lock holding portions 4 are arranged so as to project from flexible holding strips 6*a*. Unlock tabs 6*c* are provided on free ends of the flexible holding strips 6***a*, the free ends being on the rear side of the strips 6*a*.

On the front side of the female connector housing B is a hood portion $B_1$. Pin guide grooves 7 for receiving the driven pins 5 are arranged on both sides of the hood portion $B_1$. Each pin guide groove 7 matches an entrance portion 2*a* of the cam groove 2 of the engagement drive cam C that is in an inoperative condition. The engagement drive cam C is held in an upright position by a plate spring 8, such position being an inoperative position.

Therefore, in engaging the male and female connector housings A, B with each other, the driven pins 5 enter into the cam grooves 2 from the pin guide grooves 7. Then, under this condition, the engagement drive cam C is turned by the operation lever portion 3, so that the male connector housing A can be drawn into the hood portion $B_1$ of the female connector housing B through both the cam grooves 2 and the driven pins 5, and the engaged condition can be maintained by causing the lock holding portions 4 to be fitted with the lock projections 6*b* upon completion of the engagement. Terminal accommodating chambers 9, 10 that confront each other are formed in the male and female connector housings A, B. Terminal fittings (not shown) to be accommodated in the terminal accommodating chambers 9, 10 are connected under the engaged condition.

Figure 2:
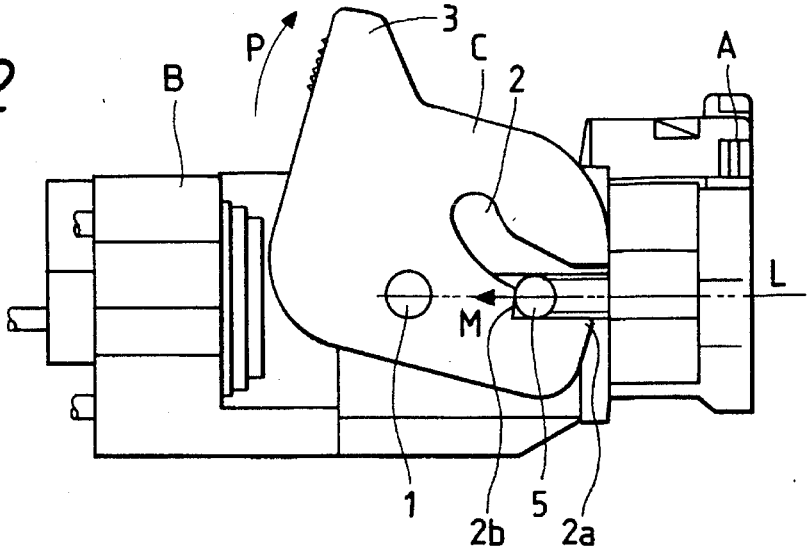
FIG. 2 is a side view showing details of a cam groove of the device.
Figure 3:
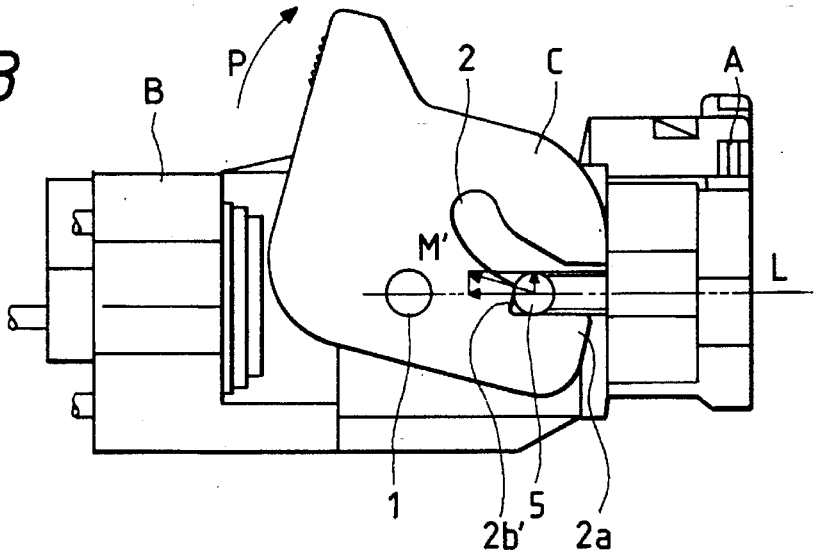
FIG. 3 is a side view showing a cam groove, which is modified embodiment of the first embodidment.
Figure 4:
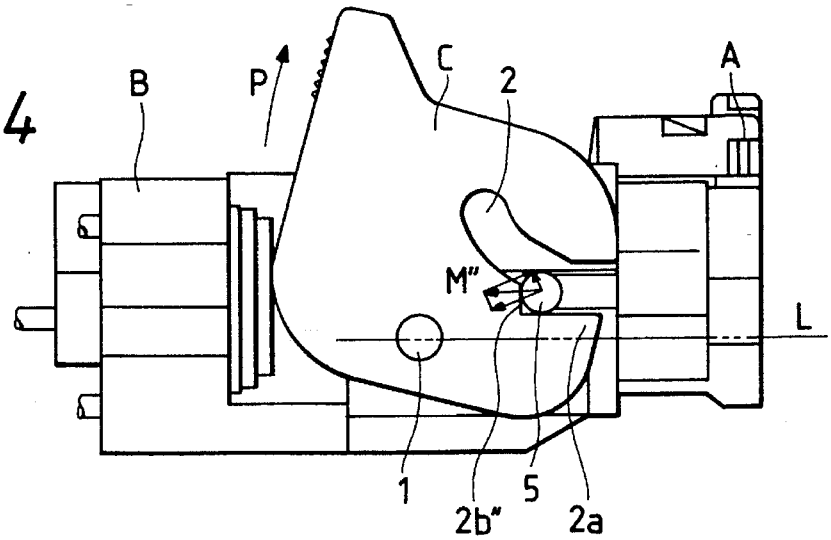
FIG. 4 is a side view showing a cam groove, which is still modified embodiment of the first embodiment.

FIGS. 2 to 4 show details of modified examples of the cam groove 2. Colliding stepped portion 2*b*, 2*b*', or 2*b*" is formed contiguous to the entrance portion 2*a*. In the inoperative condition of the engagement drive cam that is designed to turn in a direction indicated by an arrow P, the colliding stepped portion 2*b*, in the case of FIG. 2, extends on a line of engagement direction L passing through the support shaft 1 of the male and female connector housings A, B and confronts the support shaft 1. Since a force M acting on the engagement drive cam C at the time the colliding stepped portion 2*b* collides against the driven pin 5 coincides with the line of engagement direction L, the engagement drive cam C does not turn. The line of engagement direction L demarcates between the front side and the rear side of the engagement drive cam C relative to the turn direction thereof.

In the case of FIG. 3, the colliding stepped portion 2*b*' extends on the engagement direction line L that passes through the support shaft 1 and is tapered. This produces a force M' opposing the engagement drive cam C turn direction P at the time the colliding stepped portion 2*b*' collides against the driven pin 5. As a result, the engagement drive cam C does not turn.

In the case of FIG. 4, the colliding stepped portion 2*b*" is positioned rearward relative to the engagement direction line L passing through the support shaft 1 in the engagement drive cam C turn direction P. A force M" acting in the engagement direction does not, therefore, turn the engagement drive cam C.

As described above, an engagement drive cam having cam grooves is arranged on one of a pair of connector housings that are engaged with each other in such a manner that the engagement drive cam can turn around a support shaft thereof; driven pins entering into the cam grooves are arranged on the other connector housing; and colliding stepped portions against the driven pins are arranged at entrance portions of the cam grooves, so that the colliding stepped portions are positioned rearward relative to the engagement direction line passing through the support shaft in the engagement drive cam turn direction. As a result, the initial engagement position of the pair of connector housings can be established without turning the engagement drive cam at the time of engaging these connector housings, thereby preventing trouble such as accidental contact of terminal fittings in the respective connector housings.

More specifically, the front side and the rear side are described in more detail.

Figure 9:
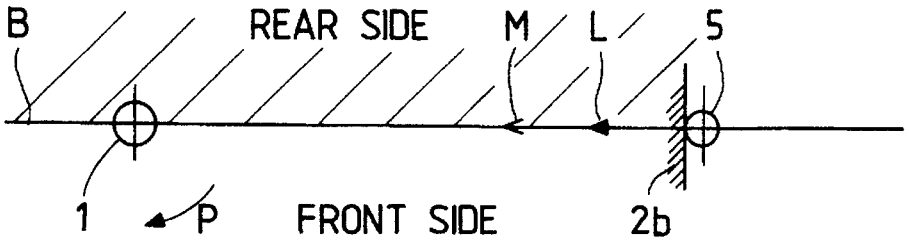
FIGS. 9 to 11 are diagrams of the front side and the rear side with respect to the rotation direction of the engagement drive cam, and correspond to FIGS. 2–4, respectively.
Figure 10:
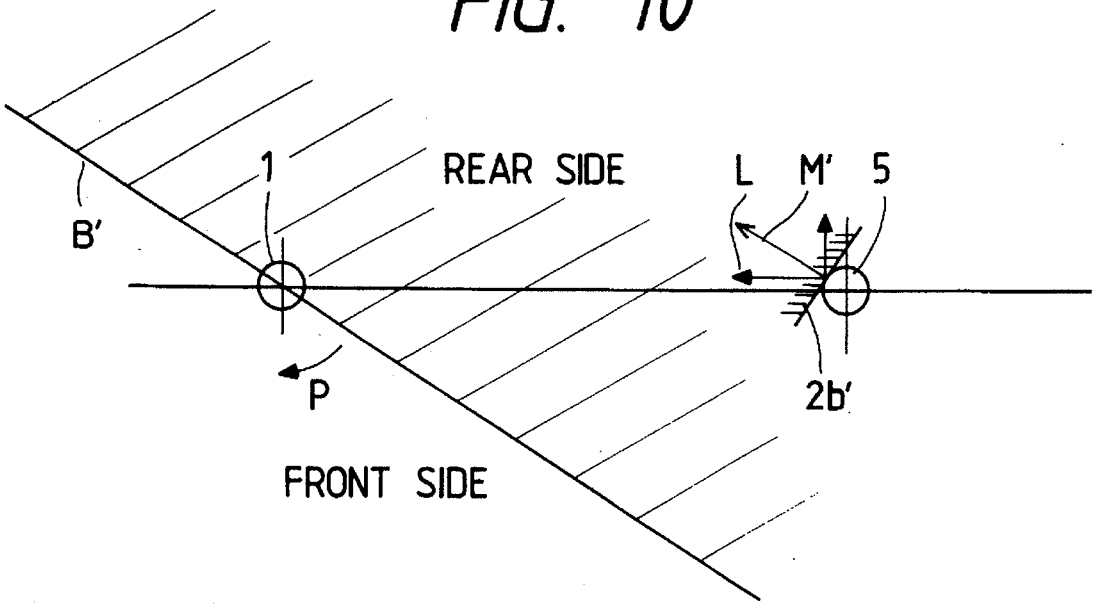
Figure 11:
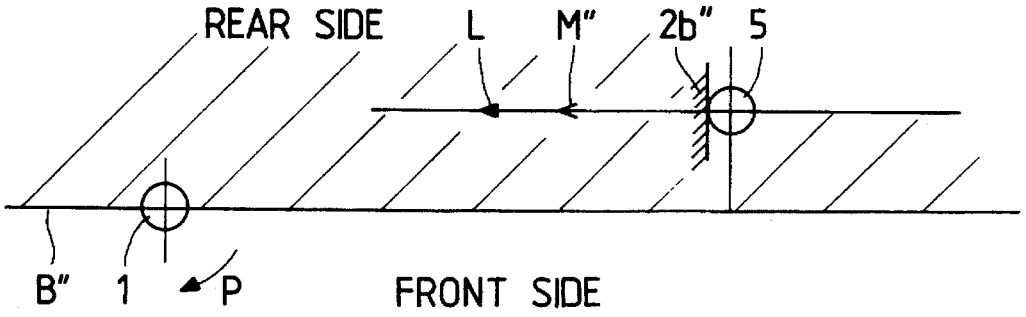

FIGS. 9–11 are diagrams of the front side and the rear side with respect to the rotation direction of the engagement drive cam, and correspond to FIGS. 2–4, respectively.

FIGS. 9–11 show rotation border lines B, B' and B", respectively. In those figures, an area defined by upper portion from the rotation border line is the rear side and an area defined by lower portion from the rotation border line is the front side. In FIG. 9, the rotation border line B passes through the support shaft 1 in the direction parallel to the direction of the force M which is orthogonal to a surface of the colliding stepped portion 2*b*. Namely, the force M is effected to the engagement drive cam C. The direction of the force M is substantially coincident to the direction of the rotation border line B.

In FIG. 10, the direction of the force M' is positioned in the rear side from the rotation border line B'. In FIG. 11, the direction of the force M" is positioned in the rear side from the rotation border line B".

Second embodiment of the present invention will now be described hereinafter.

Figure 5:
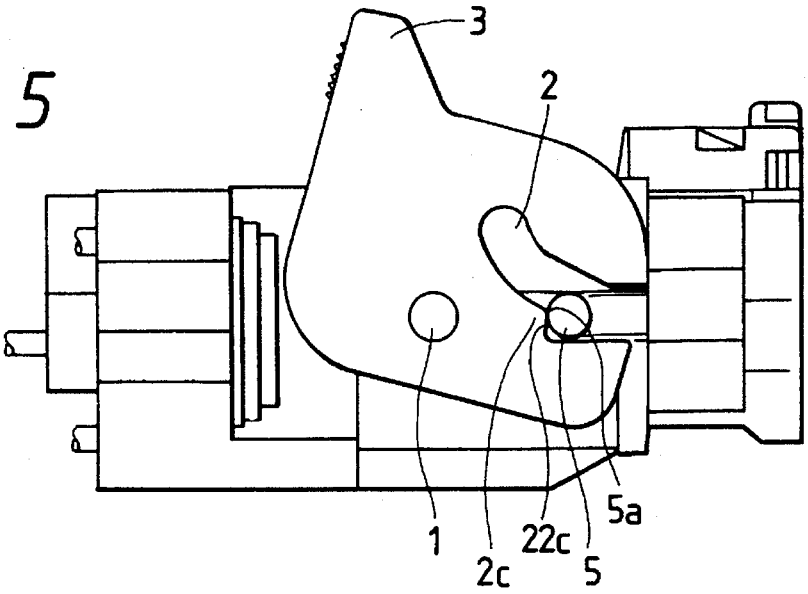
FIG. 5 is a side view showing a cam groove, which is second embodiment of the present invention.

FIG. 5 shows a side view of the second embodiment of the present invention. The driven pin 5 has a surface 5*a* defined on the front portion thereof in the direction of the terminal insertion direction. A prejection 2*c* is formed in the cam groove 2. The surface 5*a* is the same surface 22*c* of a prejection 2*c* in shape. The surface 5*a* is brought into contact with a surface 22*c* of the prejection 2*c* Other aspect of are the same as those of the first embodiment.

As described above, when the driven pin 5 comes into collision with the prejection 2*c*, a pressing force is dispersed so as to prevent the projection 2*c* from being broken. Namely, this structure is to avoid the change of the pressing force direction due to the breakage of the prejection 22*c*.

Third embodiment of the present invention will now be described hereinafter.

Figure 6:
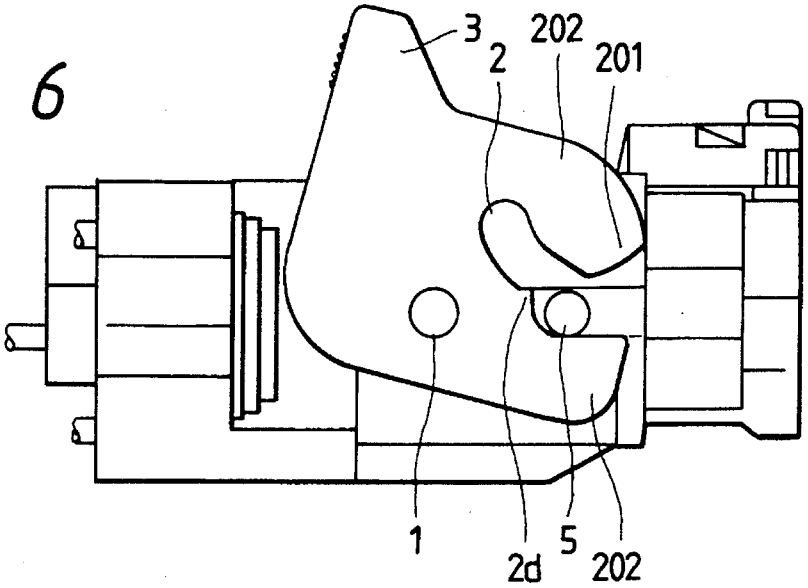
FIG. 6 is a side view showing a cam groove, which is third embodiment of the present invention.

FIG. 6 illustrates a side view of the third embodiment of the present invetion. A projection 2*d* is mounted into the cam groove 2 at substantially the middle portion of the cam groove 2. The profile of an opening edge portion 201 of the cam groove 2 is formed toward the rear side in such a manner that a distance of a opening defined by arms 202 of the cam 2 is wider than distance defined by arms 101 of the cam 2 as shown in the first embodiment of the present invention.

Figure 7:
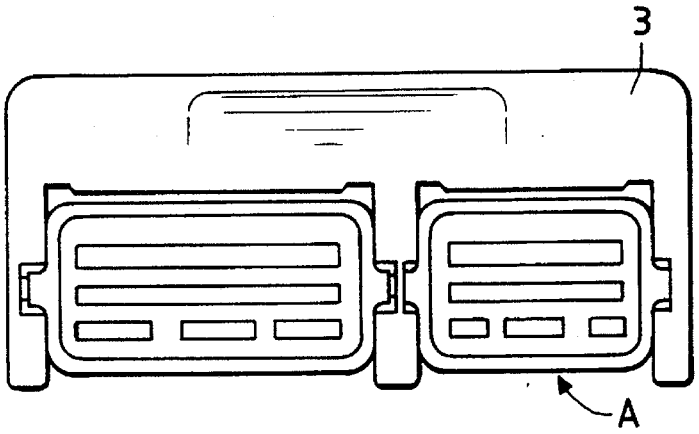
FIG. 7 is a front view showing the cam groove, which is the third embodiment of the present invention.
Figure 8A:
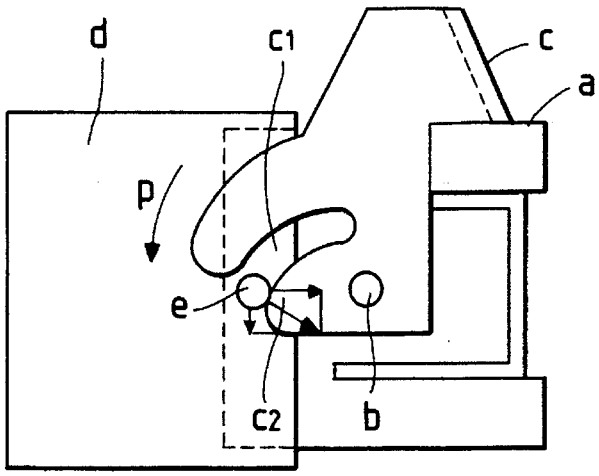
FIGS. 8(A), (B) and (C) are side views showing the process of engaging a pair of coventional connector housings with each other.
Figure 8B:
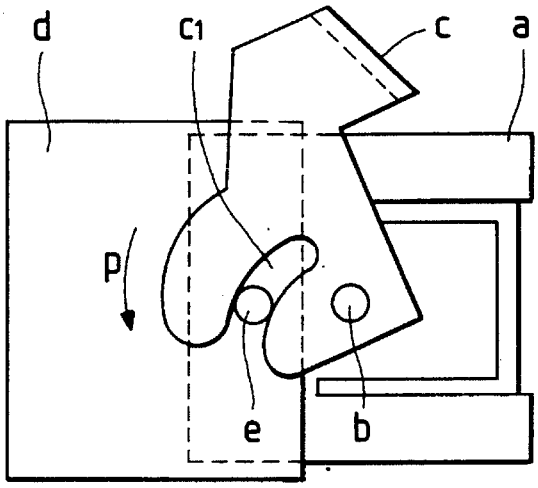
Figure 8C:
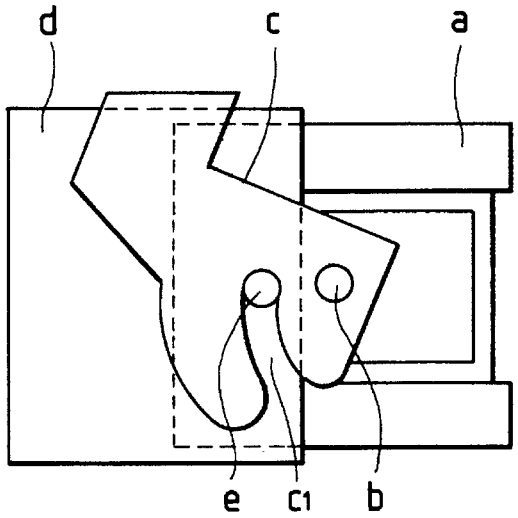

In this configuration, at the initial stage of the engaging the male and female connector housings, a sloped surface existing between an entrance portion of cam groove 2 and the projection 2*d* is pressed by the driven pin 5 to slightly rotate the cam 2. Subsequently, the projection 2*d* collides with the driven pin 5 to stop the rotation of the cam. At that time, even if a type of connector involving a single cam for engaging a plurality of juxtaposed connectors as shown in FIG. 7, the opening of the cam groove for inserting another connector is not be closed at the time of inserting a connector. Of course, this embodiment of the present invention is capable for a connector having a pair of female and male connector housings.

What is claimed is:

1. A low inserting and extracting force connector, comprising:

a pair of connector housings engageable with each other;

an engagement drive cam having cam grooves, the engagement drive cam being arranged so as to be pivotably disposed about a support shaft provided on one of said pair of connector housings so as to be rotatable from a first position to a second position; and driven pins, arranged on the other of said connector housings, said driven pins being respectively received in said cam grooves so as to cam said other connector housing in an insertion direction toward said one connector housing when said drive cam is rotated in an engagement direction toward said second position, wherein each of said cam grooves includes a pin contact portion which is initially contacted by an associated driven pin when said connector housings are provisionally engaged with each other with said drive cam in said first position, said pin contact portion including a contact surface against which said driven pin .abuts, aid contact surface being physically located along a rotation border line or on a side of said rotation border line opposite a direction in which said pin contact portion moves when said drive cam is moved in said engagement direction toward said second position, said rotation border line passing through said support shaft and being perpendicular to a tangent to said contact surface.

2. A low inserting and extracting force connector as claimed in claim 1, wherein said stepped portion includes a tapered surface.

3. A low inserting and extracting force connector as claimed in claim 1, wherein said pin contact portion includes a stepped portion and is arranged at an entrance portion of the cam groove.

4. A low inserting and extracting force connector as claimed in claim 1, wherein said pin contact portion includes a projection and is arranged at a mid-portion of the cam groove.

5. A low inserting and extracting force connector as claimed in claim 4, wherein a profile of a front portion of the driven pin is formed so as to compliment a profile of the projection.

6. A low inserting and extracting force connector comprising:

a plurality of female and male connector housings engageable with each other;

an engagement drive cam having cam grooves, the engagement drive cam being arranged so as to be pivotably disposed about a support shaft provided on one of the female and male connector housings so as to be rotatable from a first position to a second position; and driven pins, arranged on the other of the female and male connector housings, said driven pins being respectively received in said cam grooves so as to cam said connector housings in an insertion direction towards each other when said drive cam is rotated in an engagement direction toward said second position, wherein each of said cam grooves includes a pin contact portion which is initially contacted by an associated driven pin when said connector housings are provisionally engaged with each other with said drive cam is in said first position, said pin contact portion including a contact surface against which said driven pin abuts, said contact surface being physically located along a rotation border line or on a side of said rotation border line opposite a direction in which said pin contact portion moves when said drive cam is moved in said engagement direction toward said second position, said rotation border line passing through said support shaft and being perpendicular to a tangent to said contact surface.

7. A low inserting and extracting force connector as claimed in claim 6, wherein when said one connector housing is inserted into said other connector housing, an entrance portion of each cam groove is maintained at a predetermined position to receive an associated driven pin.

* * * * *